US006354966B1

(12) United States Patent
Takemura et al.

(10) Patent No.: US 6,354,966 B1
(45) Date of Patent: Mar. 12, 2002

(54) MULTI-PIECE SOLID GOLF BALL

(75) Inventors: Kouhei Takemura, Nara; Tetsuo Yamaguchi, Nishinomiya; Seigou Sakagami, Ashiya; Masaya Tsunoda; Jun Ochi, both of Akashi, all of (JP)

(73) Assignee: Sumitomo Rubber Industries, Ltd., Hyogo-ken (JP)

( * ) Notice: Subject to any disclaimer, the term of this patent is extended or adjusted under 35 U.S.C. 154(b) by 0 days.

(21) Appl. No.: 09/662,886

(22) Filed: Sep. 15, 2000

(30) Foreign Application Priority Data

Sep. 17, 1999 (JP) ..... 11-263628

(51) Int. Cl.[7] ..... A63B 37/04; A63B 37/06; A63B 37/08

(52) U.S. Cl. ..... 473/374; 473/373; 473/371; 473/370; 473/376

(58) Field of Search ..... 473/351, 367, 473/368, 370, 371, 374, 376, 377, 354, 373; 525/221

(56) References Cited

U.S. PATENT DOCUMENTS

| | | | | |
|---|---|---|---|---|
| 5,772,531 A | | 6/1998 | Ohsumi et al. | |
| 5,803,831 A | * | 9/1998 | Sullivan et al. | 473/374 |
| 5,984,806 A | * | 11/1999 | Sullivan et al. | 473/373 |
| 6,015,356 A | * | 1/2000 | Sullivan et al. | 473/373 |
| 6,057,403 A | * | 5/2000 | Sullivan et al. | 525/221 |
| 6,083,119 A | * | 7/2000 | Sullivan et al. | 473/354 |
| 6,130,296 A | * | 10/2000 | Yabuki et al. | 525/221 |
| 6,204,331 B1 | * | 3/2001 | Sullivan et al. | 525/221 |
| 6,213,895 B1 | * | 4/2001 | Sullivan et al. | 473/374 |

FOREIGN PATENT DOCUMENTS

JP A10127818 5/1998

OTHER PUBLICATIONS

Callister, Jr., William D., Materials Science and Engineering: An Introdution, 4th Edition, New York: John Wiley & Sons, Inc., 1997, p. 125, 778.* eFunda Engineering Fundamentals, copyright 2001 (www.e-funda.com).*

Department of Material Science and Engineering, Materials by Design, Copyright 1996, Cornell University (www.m-se.cornell.edu/courses/engri111/modulus.htm).*

* cited by examiner

*Primary Examiner*—Jeanette Chapman
*Assistant Examiner*—Alvin A. Hunter, Jr.
(74) *Attorney, Agent, or Firm*—Birch, Stewart, Kolasch & Birch, LLP

(57) ABSTRACT

A multi-piece solid golf ball has rebound characteristics equal to conventional two-piece solid golf ball when hitting at high head speed, and better rebound characteristics when hitting at low head speed. This multi-piece solid golf ball has a core with an inner layer outer layer on the inner layer, and at least one layer of cover on the core, the inner layer core having an elastic modulus of 50 to 200 MPa, the outer layer core having at least one layer of low elastic modulus with elastic modulus lower than the inner layer core by 15 to 100 MPa; at least one layer of the lowest elastic modulus layer in the core has a total thickness of 0.2 to 5.0 mm and is placed from 6.5 to 20.5 mm away from the core center point with diameter 37 to 41 mm.

18 Claims, 4 Drawing Sheets

MULTI-PIECE SOLID GOLF BALL

FIELD OF THE INVENTION

The present invention relates to a multi-piece solid golf ball having high trajectory and excellent flight performance by accomplishing low spin amount, high launch angle and high rebound characteristics.

BACKGROUND OF THE INVENTION

There have been various requirements for physical properties of golf balls, such as flight distance, controllability, shot feel, click sound and the like. Among them, long flight distance always fascinates general golfers and is generally accomplished by increasing coefficient of restitution, reducing spin amount or heightening launch angle. Particularly, a golf ball with high trajectory visually satisfies golfers, and golf ball makers have developed golf balls having high launch angle. In order to heighten launch angle, it is known to the art to soften the whole golf ball, or to adjust hardness distribution such that an outer portion is harder and an inner portion is softer.

However, there is a problem that a golf ball generally has a low coefficient of restitution, which reduces flight distance. In the golf ball adjusting the hardness distribution that the outer portion is harder and the inner portion is softer, there is another problem that the spin amount is low, but the initial velocity is low, which reduces flight distance, when compared with a golf ball having an even hardness distribution.

OBJECTS OF THE INVENTION

A main object of the present invention is to provide a multi-piece solid golf ball having high trajectory and excellent flight performance by accomplishing low spin amount, high launch angle and high rebound characteristics.

According to the present invention, the object described above has been accomplished by forming a multi-piece solid golf ball comprising a core composed of an inner layer core placed in the innermost layer and at least one layer of an outer layer core formed on the inner layer, and a cover formed on the core, in which the lowest elastic modulus layer having the lowest elastic modulus is placed in the core, and an elastic modulus of the inner layer core, an elastic modulus difference between the inner layer core and the lowest elastic modulus layer, a thickness and position of the lowest elastic modulus layer, and a diameter of the core are adjusted to a specified range. The present invention materializes low spin amount, high launch angle and high rebound characteristics, and provides a multi-piece solid golf ball having high trajectory and excellent flight performance.

This object as well as other objects and advantages of the present invention will become apparent to those skilled in the art from the following description with reference to the accompanying drawings.

BRIEF EXPLANATION OF DRAWINGS

The present invention will become more fully understood from the detailed description given hereinbelow and the accompanying drawings which are given by way of illustration only, and thus are not limitative of the present invention, and wherein.

SUMMARY OF THE INVENTION

The present invention provides a multi-piece solid golf ball comprising;

a core composed of an inner layer core and at least one layer of an outer layer core formed on the inner layer, and at least one layer of a cover formed on the core, wherein the inner layer core has an elastic modulus of 50 to 200 MPa, the outer layer core comprises at least one layer of a low elastic modulus layer having an elastic modulus lower than that of the inner layer core by 15 to 100 MPa, at least one layer of the lowest elastic modulus layer having the lowest elastic modulus in the core has a total thickness of 0.2 to 5.0 mm and is placed in a range of 6.5 to 20.5 mm away from the center point of the core, and the core has a diameter of 37 to 41 mm.

Figure 4:
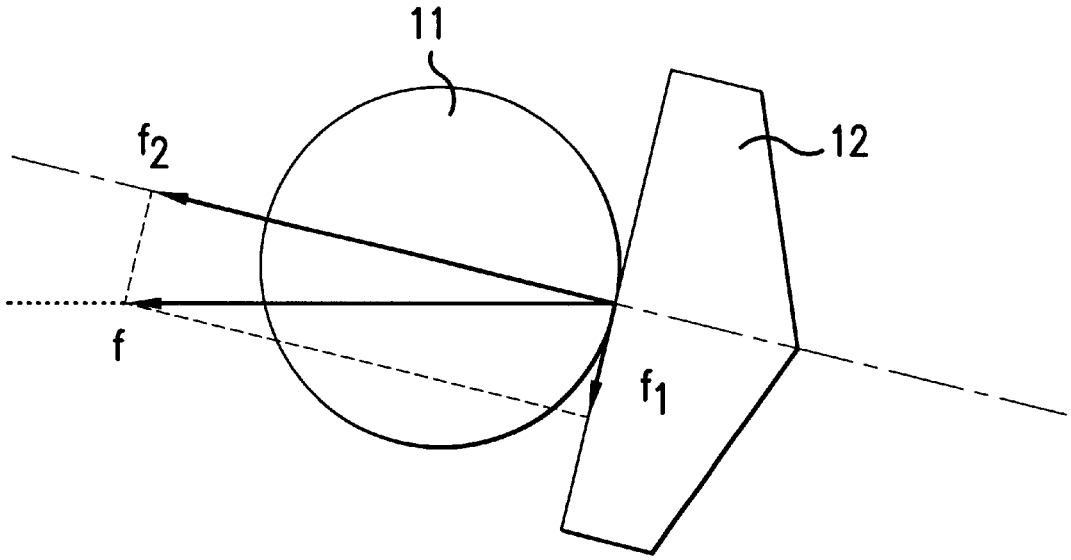
FIG. 4 is a schematic cross section explaining the force applied to a golf ball at the time of hitting.

A golf club face has a loft angle, and a direction of admitting the golf club to the golf ball deviates from that of pushing the golf ball out by the loft angle. Therefore the force applied to the golf ball from the direction of admitting the golf club is divided into components in a direction vertical to the club face and a direction parallel to the club face. It will be explained with reference to the accompanying drawing in detail. FIG. 4 is a schematic cross section explaining the force applied to a golf ball at the time of hitting. As shown in FIG. 4, the force f applied to the golf ball 11 from the direction of admitting the golf club 12 is divided into the component $f_2$ in a direction vertical to the club face and the component $f_1$ in a direction parallel to the club face. It is considered that the reason why the golf ball has different launch angle depending on types of golf balls even if using a same golf club is caused by a deformation of a golf ball based on the parallel component force $f_1$ by the club face.

Figure 5:
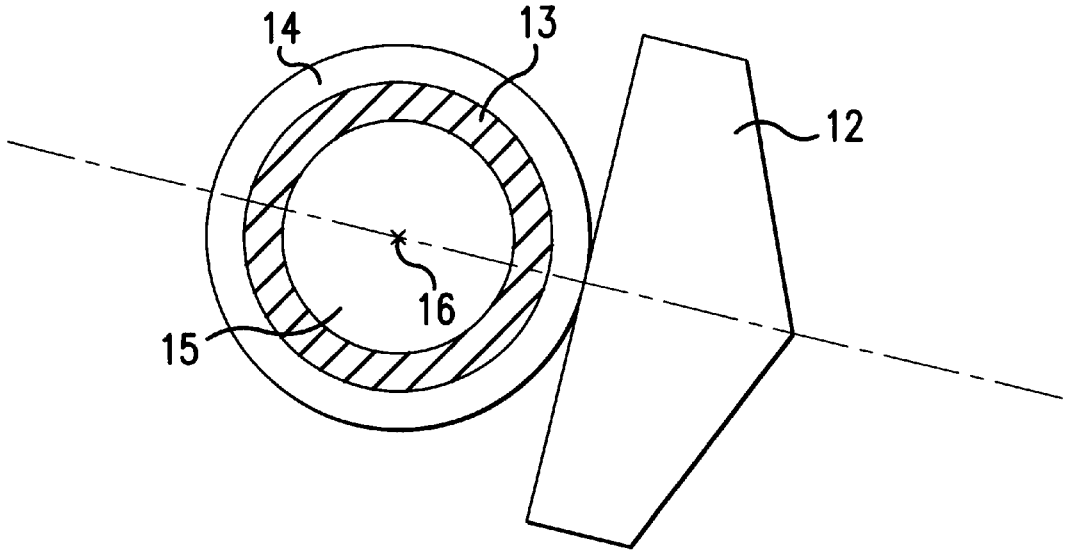
FIG. 5 is a schematic cross section illustrating the golf ball comprising a layer having low elastic modulus in an intermediate layer of the golf ball contacted with the club face.
Figure 6:
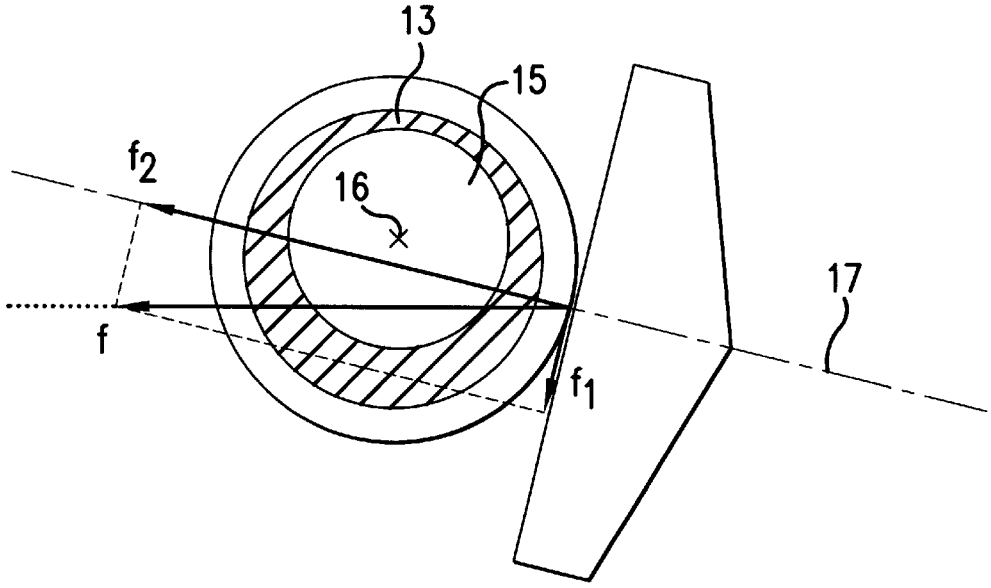
FIG. 6 is a schematic cross section explaining the deformation of the golf ball comprising a layer having low elastic modulus in an intermediate layer of the golf ball.

A golf ball comprising a layer having low elastic modulus in an intermediate layer will be explained with reference to the accompanying drawing in detail. FIG. 5 is a schematic cross section illustrating the golf ball comprising a layer 13 having low elastic modulus in an intermediate layer contacted with the club face. FIG. 6 is a schematic cross section explaining the deformation of the golf ball comprising the layer 13. When applying the component force $f_1$ on the golf ball, the cover of the golf ball is downwardly stretched in the $f_1$ direction. When placing a layer 13 having low elastic modulus in an intermediate layer of the golf ball as shown in FIG. 6, the deformation of the intermediate layer is large, and the center portion 15 of the golf ball is upwardly left in the $f_1$ direction. Therefore the center of gravity 16 of the golf ball is upwardly shifted and present above a line 17 perpendicularly extended from the point where force is applied on the club face. The more upwardly the center of gravity of the golf ball is present, the higher a launch angle of the golf ball is. A generation of backspin is relaxed by the deformation of the golf ball, because of the upward movement of the center of gravity, and then the spin amount is low. Therefore the golf ball of the present invention having the above structure has low spin amount and high launch angle.

In the golf ball of the present invention, the layer 13 is present in an intermediate layer of the golf ball, because at least one layer of low elastic modulus layer having an elastic modulus lower than that of the inner layer core by 15 to 100 MPa, is contained in the intermediate layer and at least one layer of the lowest elastic modulus layer having the lowest elastic modulus in the core, which is comprised in the low elastic modulus layer, has a thickness of 0.2 to 5.0 mm, and placed in a range of 6.5 to 20.5 mm away from the center point of the core. When hitting the golf ball at a low head speed, the deformation does not reach to the low elastic modulus portion but takes effect only on the high elastic modulus portion. The high elastic modulus portion gives high rebound characteristics enough to cover the decrease of rebound characteristics by hitting at a low head speed, or to improve the rebound characteristics.

However, if a layer, which has an elastic modulus lower than that of the inner layer core by 15 to 100 MPa, but which is not the lowest elastic modulus layer, is present, the position of the layer reaches a little out of the range of 6.5 to 20.5 mm away from the center point of the core, and the above technical effect is not sufficiently obtained. Therefore, in order to practice the present invention suitably, it is preferable that the low elastic modulus layer in the outer layer core 2 has a total thickness of 0.2 to 5.0 mm and is placed in a range of 6.5 to 20.5 mm away from the center point of the core, and the outer layer core 2 has an elastic modulus of 5 to 200 MPa.

DETAILED DESCRIPTION OF THE INVENTION

Figure 1:
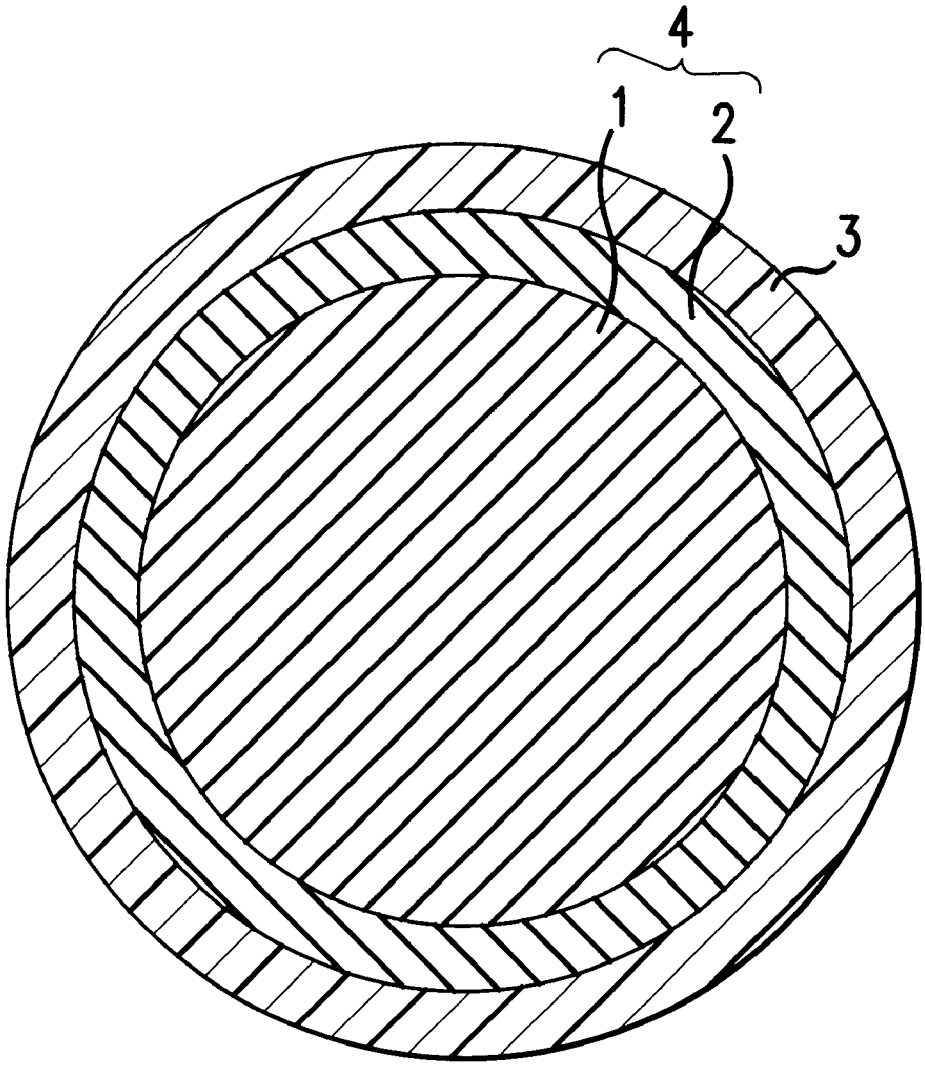
FIG. 1 is a schematic cross section illustrating one embodiment of the golf ball of the present invention.

The multi-piece solid golf ball of the present invention will be explained with reference to the accompanying drawing in detail. FIG. 1 is a schematic cross section illustrating one embodiment of the multi-piece solid golf ball of the present invention. As shown in FIG. 1, the golf ball of the present invention comprises a core 4 composed of an inner layer core 1 placed in the innermost layer and at least one layer of outer layer core 2 formed on the inner layer, and at least one layer of cover 3 covering the core. In order to explain the golf ball of the present invention simply, a golf ball having one layer of cover 3 will be used hereinafter for explanation. However, the golf ball of the present invention may be applied for the golf ball having two or more layers of cover.

The core 4, including the inner layer core 1 and the outer layer core 2, is obtained by press-molding a rubber composition. The rubber composition essentially contains polybutadiene, a co-crosslinking agent, an organic peroxide and a filler. Since the both layers in the core are formed from the same vulcanized rubber composition, each layer has high adhesion to the contiguous layer, and it is difficult to separate the layer from the contiguous layer. Therefore high rebound characteristics and high durability can be maintained while balancing those.

The polybutadiene used for the core 4 of the present invention may be one, which has been conventionally used for cores of solid golf balls. Preferred is high-cis polybutadiene rubber containing a cis-1,4 bond of not less than 40%, preferably not less than 80%, more preferably not less than 90%. The high-cis polybutadiene rubber may be optionally mixed with natural rubber, polyisoprene rubber, styrene-butadiene rubber, ethylene-propylene-diene rubber (EPDM) and the like in amount of 0 to 50 parts by weight based on 100 parts by weight of the polybutadiene.

The co-crosslinking agent can be a metal salt of α,β-unsaturated carboxylic acid, including mono or divalent metal salts, such as zinc or magnesium salts of α,β-unsaturated carboxylic acids having 3 to 8 carbon atoms (e.g. acrylic acid, methacrylic acid, etc.), a functional monomer such as triethanolpropane trimethacrylate, or mixtures thereof. The preferred co-crosslinking agent is zinc acrylate because it imparts high rebound characteristics to the resulting golf ball. The amount of the co-crosslinking in the rubber composition is from 5 to 50 parts by weight, preferably from 10 to 40 parts by weight, based on 100 parts by weight of the polybutadiene. When the amount of the co-crosslinking is larger than 50 parts by weight, the core is too hard, and shot feel is poor. On the other hand, when the amount of the co-crosslinking is smaller than 5 parts by weight, it is required to increase an amount of the organic peroxide in order to impart a desired hardness to the core. Therefore, the rebound characteristics are degraded, which reduces the flight distance.

The organic peroxide includes, for example, dicumyl peroxide, 1,1-bis(t-butylperoxy)-3,3,5-trimethylcyclohexane, 2,5-dimethyl-2,5-di(t-butylperoxy) hexane, di-t-butyl peroxide and the like. The preferred organic peroxide is dicumyl peroxide. The amount of the organic peroxide is from 0.3 to 5.0 parts by weight, preferably 0.8 to 3.0 parts by weight, based on 100 parts by weight of the polybutadiene. When the amount of the organic peroxide is smaller than 0.3 parts by weight, the core is too soft, and the rebound characteristics are degraded, which reduces the flight distance. On the other hand, when the amount of the organic peroxide is larger than 5.0 parts by weight, it is required to decrease an amount of the co-crosslinking agent in order to impart a desired hardness to the core. Therefore, the rebound characteristics are degraded, which reduces the flight distance.

The filler, which can be typically used for the core of solid golf ball, includes for example, inorganic filler (such as zinc oxide, barium sulfate, calcium carbonate and the like), high specific gravity metal powder filler (such as tungsten powder, molybdenum powder and the like), and mixtures thereof. The amount of the filler is 3 to 50 parts by weight, preferably 10 to 30 parts by weight, based on 100 parts by weight of the polybutadiene. When the amount of the filler is smaller than 3 parts by weight, it is difficult to adjust the weight of the resulting golf ball. On the other hand, when the amount of the filler is larger than 50 parts by weight, the weight ratio of the rubber component in the core is small, and the rebound characteristics reduce too much.

The rubber composition for the core of the golf ball of the present invention can contain other components, which have been conventionally used for preparing the core of solid golf balls, such as antioxidant or peptizing agent, or organic sulfide compound (e.g. sulfides or thiols). If used, the amount of the antioxidant is preferably 0.1 to 1.0 parts by weight, that of the peptizing agent is preferably 0.1 to 5.0 parts by weight, and that of the organic sulfide compound is preferably 0.1 to 5.0 parts by weight, based on 100 parts by weight of the polybutadiene.

The inner layer core 1 and the outer layer core 2 of the present invention are formed from the same components as described above. Therefore the elastic modulus can be obtained by adjusting an amount of the co-crosslinking agent, an amount of the organic peroxide, vulcanization conditions and the like.

Figure 2:
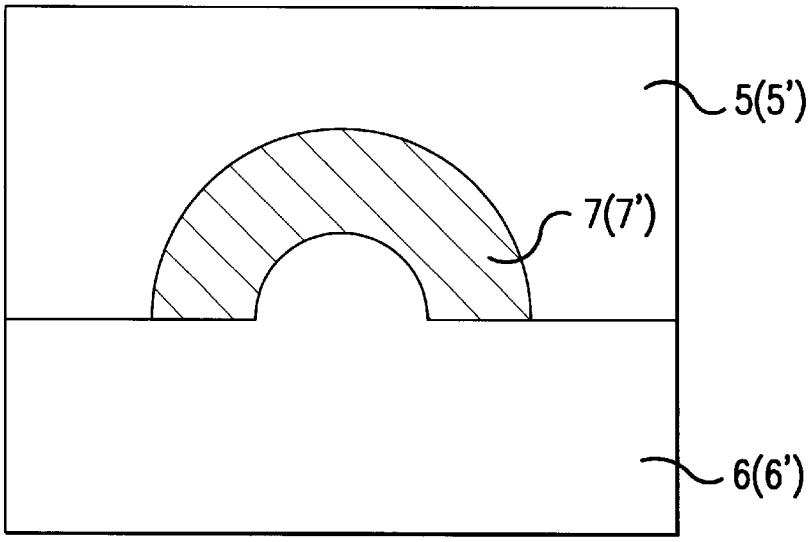
FIG. 2 is a schematic cross section illustrating one embodiment of a mold for molding a semi-vulcanized semi-spherical half-shell for the outer layer core of the golf ball of the present invention.
Figure 3:
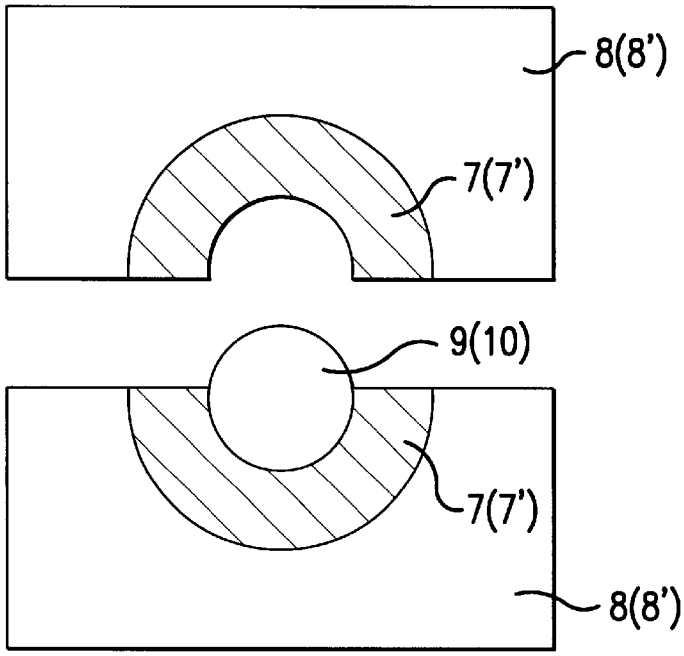
FIG. 3 is a schematic cross section illustrating one embodiment of a mold for molding the core of the golf ball of the present invention.

The process of producing the core of the golf ball of the present invention will be explained with reference to FIG. 2 and FIG. 3. FIG. 2 is a schematic cross section illustrating one embodiment of a mold for molding a semi-vulcanized semi-spherical half-shell used for the golf ball of the present invention. FIG. 3 is a schematic cross section illustrating one embodiment of a mold for molding a core of the golf ball of the present invention. The rubber composition for the inner layer core is mixed, and press-molded in a mold, which is composed of an upper mold and a lower mold having a semi-spherical cavity, at 130 to 160° C. for 10 to 60 minutes to prepare a vulcanized spherical molded article for the inner layer core. The rubber composition for the outer layer core then is mixed, and press-molded at 90 to 165° C. for 20 seconds to 5 minutes using a mold having a semi-spherical cavity 5 and a male plug mold 6 having a semi-spherical convex shape having the same diameter as the vulcanized spherical molded article for the inner layer core as described in FIG. 2 to obtain a semi-vulcanized semi-spherical half-shell 7 for the outer layer core. The vulcanized molded article for the inner layer core 9 is covered with the two semi-vulcanized semi-spherical half-shells 7 for the outer layer core, and then press-molded at 140 to 160° C. for 10 to 60 minutes in a mold 8 as described in FIG. 3 to prepare a two-layer structured core.

Figure 7:
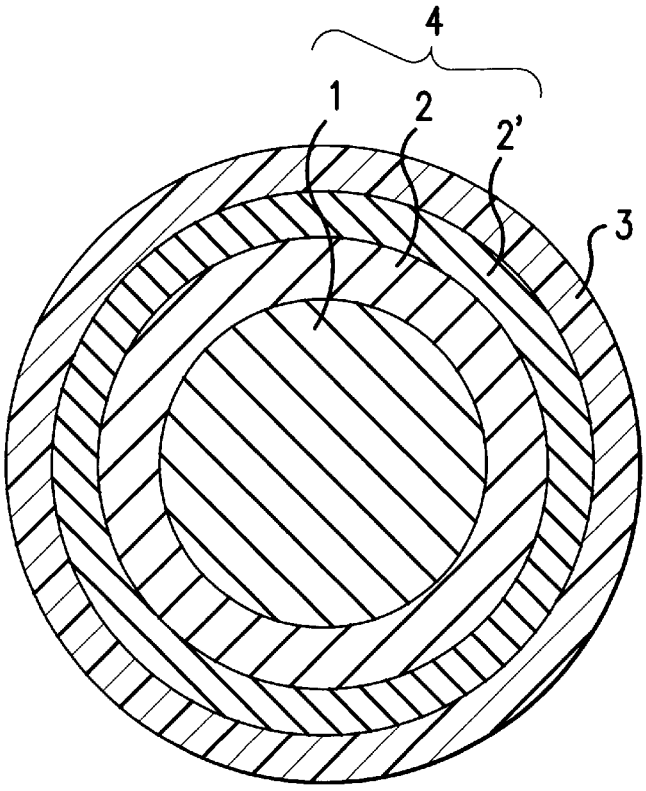
FIG. 7 is a schematic cross section illustrating another embodiment of the golf ball of the present invention.

In case that the outer layer core 2 has a two-layered structure, the rubber composition for outer layer core mixed, and a semi-vulcanized semi-spherical half-shell 7' for the outer layer core are prepared in the same procedure as the semi-vulcanized semi-spherical half-shell 7 for the outer layer core except for using a mold having a semi-spherical cavity 5' and a male plug mold 6' having a semi-spherical convex having the same diameter as the two-layer structured core as described in FIG. 2. The two-layer structured core 10 is covered with the two semi-vulcanized semi-spherical half-shells 7' for the outer layer core, and then press-molded at 140 to 160° C. for 10 to 60 minutes in a mold 8' as described in FIG. 3 to prepare the core 4 having a three-layered structure. The golf ball of the present invention comprising the core 4 having the three-layered structure is described in FIG. 7. The core having four or more layers, which comprises three or more layers of the outer layer core, can be prepared by repeating the procedure as described above. The method of preparing the core is not limited to the press-molding method, but may be conducted by using a rubber injection-molding method. After press-molding and vulcanizing the inner layer core and the core having two or more layers obtained by forming the outer layer core on the inner layer core respectively, the surface of each molded article can be buffed to improve the adhesion to the contiguous layer.

In the golf ball of the present invention, it is required that the inner layer core 1 placed in the innermost layer have an elastic modulus of 50 to 200 MPa, preferably 55 to 170 MPa, more preferably 58 to 155 MPa. When the elastic modulus of the inner layer core 1 is smaller than 50 MPa, the rebound characteristics are degraded. On the other hand, when the elastic modulus is larger than 200 MPa, the impact force at the time of hitting is large, and the shot feel is poor.

It is desired that the inner layer core have a diameter of 13.0 to 40.6 mm, preferably 18.0 to 39.0 mm. When the diameter is larger than 40.6 mm, the thickness of the layer having low elastic modulus is small, and the technical effect of accomplishing high launch angle and low spin amount by placing the layer having low elastic modulus in an intermediate layer of the golf ball is not sufficiently obtained. On the other hand, when the diameter is smaller than 13.0 mm, the portion of the golf ball upwardly left in the direction parallel to the club face at the time of hitting is small, and the technical effect of accomplishing good shot feel and low spin amount is not sufficiently obtained.

The term "elastic modulus" as used herein refers to a complex elastic modulus E* determined as follows. A sample of 20 mm(length)×0.5 mm(thickness)×4 mm(width) is cut from each portion in the core, and forcibly vibrated using a viscoelastic spectrometer DVA-200, manufactured by Shimadzu Co. at a stretching mode and a frequency of 10 Hz to measure a vibration amplitude ratio and a phase lag between drive part and response part at room temperature, whereby a complex elastic modulus E* is determined.

In the golf ball of the present invention, it is required that the outer layer core 2 comprises at least one layer of low elastic modulus layer having an elastic modulus lower than that of the inner layer core 1 by 15 to 100 MPa. When the elastic modulus difference is smaller than 15 MPa, the technical effect of the present invention of accomplishing low spin amount and high launch angle by placing a layer of low elastic modulus in the intermediate layer as described above is not sufficiently obtained. On the other hand, when the elastic modulus difference is larger than 100 MPa, the elastic modulus of the inner layer core is too high and the impact force at the time of hitting is large, and the shot feel is poor. In addition, the spin amount is high, or the elastic modulus of the low elastic modulus layer is too low, and the rebound characteristics are degraded. Therefore the elastic modulus difference is preferably 15 to 90 MPa, more preferably 20 to 90 MPa.

It is required that at least one layer of the lowest elastic modulus layer having the lowest elastic modulus in the core have a total thickness of 0.2 to 5.0 mm, preferably 0.3 to 4.5 mm, more preferably 0.5 to 4.5 mm. When the thickness is smaller than 0.2 mm, the technical effect of the present invention of accomplishing low spin amount and high launch angle by placing a layer of low elastic modulus in the intermediate layer as described above is not sufficiently obtained. On the other hand, when the thickness is larger than 5.0 mm, the technical effect of the present invention that the rebound characteristics are not degraded when hitting at a low head speed by placing a layer of low elastic modulus in the intermediate layer is not sufficiently obtained.

It is required that the lowest elastic modulus layer be placed in a range of 6.5 to 20.5 mm, preferably 6.5 to 20.0 mm, more preferably 6.5 to 19.5 mm away from the center point of the core 4. When the lowest elastic modulus layer is placed at the distance of less than 6.5 mm from the center point, the low elastic modulus layer is present nearby the center point of the core, which makes a great contribution to the rebound characteristics, and the rebound characteristics are degraded. On the other hand, when the lowest elastic modulus layer is placed at the distance of more than 20.5 mm from the center point, the stress put on the cover is large. The phrase "the lowest elastic modulus layer is placed at a distance of 6.5 to 20.5 mm from the center point of the core 4 as used herein refers to the fact that the lowest elastic modulus layer is not present at the distance of less than 6.5 mm or more than 20.5 mm from the center point of the core.

According to preferable embodiments of the present invention, there are provided golf balls as follows.

(1) When the outer layer core 2 has a single-layered structure, there is provided a multi-piece solid golf ball comprising a core composed of an inner layer core and an outer layer core formed on the inner layer, and at least one layer of cover formed on the core, wherein the inner layer core has an elastic modulus of 50 to 200 MPa, the outer layer core has an elastic modulus lower than that of the inner layer core by 15 to 100 MPa, has a thickness of 0.2 to 5.0 mm and is placed in a range of 6.5 to 20.5 mm away from the center point of the core, and the core has a diameter of 37 to 41 mm;

(2) When the outer layer core 2 has a two-layered structure, which comprises an intermediate layer and an outer layer, there are provided (a) a multi-piece solid golf ball comprising a core composed of an inner layer core and two-layer structured outer layer core formed on the inner layer, which comprises an intermediate layer and an outer layer, and at least one layer of cover formed on the core, wherein the inner layer core has an elastic modulus of 50 to 200 MPa, the intermediate layer has the lowest elastic modulus in the core, has an elastic modulus lower than that of the inner layer core 1 by 15 to 100 MPa, has a thickness of 0.2 to 5.0 mm and is placed in a range of 6.5 to 20.5 mm away from the center point of the core, the outer layer has the same elastic modulus as the inner layer core 1, and the core has a diameter of 37 to 41 mm;

(b) a multi-piece solid golf ball comprising a core composed of an inner layer core and two-layer structured outer layer core formed on the inner layer, which comprises an intermediate layer and an outer layer, and at least one layer of cover formed on the core, wherein the inner layer core has an elastic modulus of 50 to 200 MPa, the intermediate layer has the lowest elastic modulus in the core, has an elastic modulus lower than that of the inner layer core 1 by 15 to 100 MPa, has a thickness of 0.2 to 5.0 mm and is placed in a range of 6.5 to 20.5 mm away from the center point of the core, the outer layer has an elastic modulus lower than that of the inner layer core 1 by 15 to 100 MPa, and the core has a diameter of 37 to 41 mm;

(c) a multi-piece solid golf ball comprising a core composed of an inner layer core and two-layer structured outer layer core formed on the inner layer, which comprises an intermediate layer and an outer layer, and at least one layer of cover formed on the core, wherein the inner layer core has an elastic modulus of 50 to 200 MPa, the intermediate layer has the lowest elastic modulus in the core, has an elastic modulus lower than that of the inner layer core 1 by 15 to 100 MPa, has a thickness of 0.2 to 5.0 mm and is placed in a range of 6.5 to 20.5 mm away from the center point of the core, the outer layer has an elastic modulus higher than that of the inner layer core 1, and the core has a diameter of 37 to 41 mm;

(d) a multi-piece solid golf ball comprising a core composed of an inner layer core and two-layer structured outer layer core formed on the inner layer, which comprises an intermediate layer and an outer layer, and at least one layer of cover formed on the core, wherein the outer layer has the lowest elastic modulus in the core, has an elastic modulus lower than that of the inner layer core 1 by 15 to 100 MPa, has a thickness of 0.2 to 5.0 mm and is placed in a range of 6.5 to 20.5 mm away from the center point of the core, the intermediate layer has an elastic modulus higher than that of the inner layer core 1, and the core has a diameter of 37 to 41 mm;

(e) a multi-piece solid golf ball comprising a core composed of an inner layer core and two-layer structured outer layer core formed on the inner layer, which comprises an intermediate layer and an outer layer, and at least one layer of cover formed on the core, wherein the outer layer has the lowest elastic modulus in the core, has an elastic modulus lower than that of the inner layer core 1 by 15 to 100 MPa, has a thickness of 0.2 to 5.0 mm and is placed in a range of 6.5 to 20.5 mm away from the center point of the core, the intermediate layer has an elastic modulus lower than that of the inner layer core 1 by 15 to 100 MPa, and the core has a diameter of 37 to 41 mm; and (f) a multi-piece solid golf ball comprising a core composed of an inner layer core and two-layer structured outer layer core formed on the inner layer, which comprises an intermediate layer and an outer layer, and at least one layer of cover formed on the core, wherein the intermediate layer and outer layer have the lowest elastic modulus in the core, have an elastic modulus lower than that of the inner layer core 1 by 15 to 100 MPa, have a total thickness of 0.2 to 5.0 mm and are placed in a range of 6.5 to 20.5 mm away from the center point of the core, and the core has a diameter of 37 to 41 mm.

In the golf ball of the present invention, it is preferable that at least one layer of low elastic modulus layer, which is not the lowest elastic modulus layer, have a total thickness of 0.2 to 5.0 mm and be placed at a distance of 6.5 to 20.5 mm from the center point of the core. When a layer, which is low elastic modulus layer but is not the lowest elastic modulus layer, is present in the outer layer core 2, the position of the lowest elastic modulus layer is out of the range of 6.5 to 20.5 mm away from the center point of the core in consideration of the thickness of the layer, and the technical effect of the present invention of accomplishing low spin amount and high launch angle by placing a layer having low elastic modulus in the intermediate layer of the golf ball is not sufficiently obtained.

In the golf ball of the present invention, it is desired that the outer layer core 2 have an elastic modulus of 5 to 200 MPa, preferably 5 to 150 MPa, more preferably 10 to 90 MPa, in all layers thereof. When the outer layer core 2 has a layer having an elastic modulus of less than 5 MPa, the rebound characteristics are degraded. On the other hand, when the outer layer core 2 has a layer having an elastic modulus of more than 200 MPa, the shot feel is poor.

In the golf ball of the present invention, it is desired that the cover 4 have a diameter of 37 to 41 mm, preferably 38 to 40 mm, and more preferably 38.4 to 39.5 mm. When the diameter of the core 4 is smaller than 37 mm, the rebound characteristics are degraded. On the other hand, when the diameter is larger than 41 mm, the cover formed thereon is thin, and the cover strength is not sufficiently obtained.

At least one layer of cover 3 are then covered on the core 4. If the cover 3 of the present invention has a single-layer structure, it contains as a base resin thermoplastic resin, particularly ionomer resin which has been conventionally used for the cover of golf balls. The ionomer resin may be a copolymer of α-olefin and α,β-unsaturated carboxylic acid having 3 to 8 carbon atoms, of which a portion of carboxylic acid groups is neutralized with metal ion, or mixtures thereof. Examples of the α-olefins in the ionomer preferably include ethylene, propylene and the like. Examples of the α,β-unsaturated carboxylic acid in the ionomer preferably include acrylic acid, methacrylic acid and the like. The metal ion which neutralizes a portion of carboxylic acid groups of the copolymer includes an alkali metal ion, such as a sodium ion, a potassium ion, a lithium ion and the like; a divalent metal ion, such as a zinc ion, a calcium ion, a magnesium ion and the like; a trivalent metal ion, such as an aluminum, a neodymium ion and the like; and mixture thereof. Preferred are sodium ions, zinc ions, lithium ions and the like, in view of rebound characteristics, durability and the like. The ionomer resin is not limited, but examples thereof will be shown by a trade name thereof. Examples of the ionomer resins, which are commercially available from Mitsui Du Pont Polychemical Co., Ltd. include Hi-milan 1555, Hi-milan 1557, Hi-milan 1605, Hi-milan 1706, Hi-milan 1707, Hi-milan AM7315, Hi-milan AM7317 and the like. Examples of the ionomer resins, which are commercially available from Du Pont Co., include Surlyn 7930, Surlyn 8511, Surlyn 8512 and the like. Examples of the ionomer resins, which are commercially available from Exxon Chemical Co., include Iotek 7010, Iotek 8000 and the like. These ionomer resins may be used alone or in combination.

If the cover 3 for the golf ball of the present invention has a multi-layer structure which has two or more layers, as suitable materials for the cover, one or combinations of two or more members selected from the group consisting of thermoplastic resin and thermoplastic elastomer may be used. Example of the thermoplastic resin includes the ionomer resin as described above. Examples of thermoplastic elastomers include polyamide thermoplastic elastomers, which are commercially available from Toray Co., Ltd. under the trade name of "Pebax", such as "Pebax 2533"; polyester thermoplastic elastomers, which are commercially available from Toray-Do Pont Co., Ltd. under the trade name of "Hytrel", such as "Hytrel 3548" and "Hytrel 4047"; polyurethane thermoplastic elastomers, which are commercially available from Takeda Verdishe Co., Ltd. under the trade name of "Elastoran", such as "Elastoran ET880"; polyurethane thermoplastic elastomers, which are commercially available from Dainippon Ink Chemical Co., Ltd. under the trade name of "Pandex", such as "Pandex T-8180", which is commercially available from Dainippon Ink Chemical Co., Ltd. and the like.

The cover used in the present invention may optionally contain pigments (such as titanium dioxide, etc.) and the other additives such as a dispersant, an antioxidant, a UV absorber, a photostabilizer and a fluorescent agent or a fluorescent brightener, etc., in addition to the resin component, as long as the addition of the additives does not deteriorate the desired performance of the golf ball cover.

A method of covering on the core with the cover 3 is not specifically limited, but may be a conventional method. For example, there can be used a method comprising molding the cover composition into a semi-spherical half-shell in advance, covering the core, which is covered with the outer layer core, with the two half-shells, followed by pressure molding at 130 to 170° C. for 1 to 5 minutes, or a method comprising injection molding the cover composition directly on the core to cover it. At the time of cover molding, many depressions called "dimples" may be optionally formed on the surface of the golf ball. Furthermore, paint finishing or marking with a stamp may be optionally provided after the cover is molded for commercial purpose.

In the golf ball of the present invention, the cover 3 has a total thickness of 0.84 to 3.00 mm, preferably 1.0 to 2.5 mm. When the thickness is smaller than 0.84 mm, the rebound characteristics and durability are degraded. On the other hand, when the thickness is larger than 3.0 mm, the shot feel is hard and poor. It is desired that the cover have an elastic modulus of 50 to 400 MPa, preferably 80 to 300 MPa. When the elastic modulus is lower than 50 MPa, the rebound characteristics and durability are degraded. In addition, since the technical effect of protecting the core is sufficiently obtained, the core is easy to damage, and the durability is poor. On the other hand, when the elastic modulus is higher than 400 MPa, the shot feel is poor. In addition, since the elastic modulus difference between the cover and core is large, it is easy to separate between the core and cover, and the durability is poor.

EXAMPLES

The following Examples and Comparative Examples further illustrate the present invention in detail but are not to be construed to limit the scope of the present invention.

Examples 1 to 12, 17 to 18 and Comparative Examples 1 to 7

(i) Production of Vulcanized Spherical Inner Layer Core

The rubber compositions for the inner layer core shown in Tables 1 to 4 were mixed, and the mixtures were then press-molded at 130 to 160° C. for 10 to 60 minutes in the mold, which was composed of an upper mold and a lower mold having a semi-spherical cavity, to obtain vulcanized spherical molded articles for the inner layer cores having a diameter shown in Tables 6 to 9.

(ii) Production of Semi-vulcanized Semi-spherical Half-shell for the Intermediate Layer Core The rubber compositions for intermediate layer core shown in Tables 1 to 4 were mixed, and the mixtures were then press-molded at 90 to 165° C. for 20 seconds to 3 minutes in the mold (5, 6) having a semi-spherical convex having the same diameter as the vulcanized spherical molded article for the inner layer core produced in the step (i) as described in FIG. 2 to obtain semi-vulcanized semi-spherical half-shells 7 for the intermediate layer core.

(iii) Production of Two-layer Structured Core

The vulcanized spherical molded articles for the inner layer core 9 produced in the step (i) were covered with the two semi-vulcanized semi-spherical half-shells 7 for the intermediate layer core produced in the step (ii), and then vulcanized by press-molding at 140 to 165° C. for 10 to 40 minutes in the mold 8 as described in FIG. 3 to obtain two-layer structured cores 10.

(iv) Production of Semi-vulcanized Semi-spherical Half-shell for the Outer Layer Core The rubber compositions for outer layer core shown in Tables 1 to 4 were mixed, and semi-vulcanized semi-spherical half-shells 8 for the outer layer core are produced as described in the step (ii) except for using the mold (5', 6') having a semi-spherical convex having the same diameter as the two-layer structured core produced in the step (iii) as described in FIG. 2.

(v) Production of Core

The two-layer structured cores 10 produced in the step (iii) were covered with the two semi-vulcanized semi-spherical half-shells 7' for the outer layer core produced in the step (iv), and then press-molded at 140 to 165° C. for 10 to 40 minutes in the mold 8' as described in FIG. 3 to prepare the cores having a three-layer structure, which has a diameter shown in Tables 6 to 9.

Examples 13 to 16

The two-layer structured cores having a diameter shown in Table 8 were prepared as described in Examples 1 to 12, 17 to 18 and Comparative Examples 1 to 7 except for using the two-layer structured cores prepared only in the steps (i) to (iii) as the core by using the rubber composition for the inner layer core and the rubber composition for the outer layer core shown in Table 3.

The surface of each molded article (each layer of the core) after vulcanization was buffed to improve the adhesion to the contiguous layer.

TABLE 1

| | (parts by weight) Example No. | | | | | |
|---|---|---|---|---|---|---|
| Core composition | 1 | 2 | 3 | 4 | 5 | 6 |
| (Inner layer core composition) | | | | | | |
| Polybutadiene *1 | 100 | 100 | 100 | 100 | 100 | 100 |
| Zinc acrylate *2 | 22 | 22 | 22 | 20 | 36 | 22 |
| Zinc oxide *3 | 23 | 23 | 23 | 24 | 18 | 23 |
| Dicumyl peroxide *4 | 1 | 1 | 1 | 1 | 1 | 1 |
| (Intermediate layer core composition) | | | | | | |
| Polybutadiene *1 | 100 | 100 | 100 | 100 | 100 | 100 |
| Zinc acrylate *2 | 8 | 16 | 20 | 8 | 20 | 16 |
| Zinc oxide *3 | 28 | 25 | 24 | 28 | 24 | 25 |
| Dicumyl peroxide *4 | 1 | 1 | 1 | 1 | 1 | 1 |
| (Outer layer core composition) | | | | | | |
| Polybutadiene *1 | 100 | 100 | 100 | 100 | 100 | 100 |
| Zinc acrylate *2 | 22 | 22 | 22 | 22 | 22 | 22 |
| Zinc oxide *3 | 23 | 23 | 23 | 23 | 23 | 23 |
| Dicumyl peroxide *4 | 1 | 1 | 1 | 1 | 1 | 1 |

TABLE 2

| | (parts by weight) Example No. | | | | | |
|---|---|---|---|---|---|---|
| Core composition | 7 | 8 | 9 | 10 | 11 | 12 |
| (Inner layer core composition) | | | | | | |
| Polybutadiene *1 | 100 | 100 | 100 | 100 | 100 | 100 |
| Zinc acrylate *2 | 22 | 22 | 22 | 20 | 36 | 22 |
| Zinc oxide *3 | 23 | 23 | 23 | 24 | 18 | 23 |
| Dicumyl peroxide *4 | 1 | 1 | 1 | 1 | 1 | 1 |
| (Intermediate layer core composition) | | | | | | |
| Polybutadiene *1 | 100 | 100 | 100 | 100 | 100 | 100 |
| Zinc acrylate *2 | 16 | 16 | 16 | 22 | 22 | 16 |

TABLE 2-continued

| | (parts by weight) Example No. | | | | | |
|---|---|---|---|---|---|---|
| Core composition | 7 | 8 | 9 | 10 | 11 | 12 |
| Zinc oxide *3 | 25 | 25 | 25 | 23 | 23 | 25 |
| Dicumyl peroxide *4 | 1 | 1 | 1 | 1 | 1 | 1 |
| (Outer layer core composition) | | | | | | |
| Polybutadiene *1 | 100 | 100 | 100 | 100 | 100 | 100 |
| Zinc acrylate *2 | 22 | 22 | 22 | 8 | 22 | 8 |
| Zinc oxide *3 | 23 | 23 | 23 | 28 | 23 | 28 |
| Dicumyl peroxide *4 | 1 | 1 | 1 | 1 | 1 | 1 |

TABLE 3

| | (parts by weight) Example No. | | | | | |
|---|---|---|---|---|---|---|
| Core composition | 13 | 14 | 15 | 16 | 17 | 18 |
| (Inner layer core composition) | | | | | | |
| Polybutadiene *1 | 100 | 100 | 100 | 100 | 100 | 100 |
| Zinc acrylate *2 | 20 | 22 | 36 | 22 | 22 | 22 |
| Zinc oxide *3 | 24 | 23 | 18 | 23 | 23 | 23 |
| Dicumyl peroxide *4 | 1 | 1 | 1 | 1 | 1 | 1 |
| (Intermediate layer core composition) | | | | | | |
| Polybutadiene *1 | — | — | — | — | 100 | 100 |
| Zinc acrylate *2 | — | — | — | — | 16 | 8 |
| Zinc oxide *3 | — | — | — | — | 25 | 28 |
| Dicumyl peroxide *4 | — | — | — | — | 1 | 1 |
| (Outer layer core composition) | | | | | | |
| Polybutadiene *1 | 100 | 100 | 100 | 100 | 100 | 100 |
| Zinc acrylate *2 | 8 | 19 | 19 | 21 | 19 | 40 |
| Zinc oxide *3 | 28 | 25 | 25 | 23.5 | 25 | 15 |
| Dicumyl peroxide *4 | 1 | 1 | 1 | 1 | 1 | 1 |

TABLE 4

| | (parts by weight) Comparative Example No. | | | | | | |
|---|---|---|---|---|---|---|---|
| Core composition | 1 | 2 | 3 | 4 | 5 | 6 | 7 |
| (Inner layer core composition) | | | | | | | |
| Polybutadiene *1 | 100 | 100 | 100 | 100 | 100 | 100 | 100 |
| Zinc acrylate *2 | 22 | 22 | 22 | 40 | 22 | 22 | 22 |
| Zinc oxide *3 | 23 | 23 | 23 | 15 | 23 | 23 | 23 |
| Dicumyl peroxide *4 | 1 | 1 | 1 | 1 | 1 | 1 | 1 |
| (Intermediate layer core composition) | | | | | | | |
| Polybutadiene *1 | 100 | 100 | 100 | 100 | 100 | 100 | 100 |
| Zinc acrylate *2 | 22 | 36 | 8 | 20 | 8 | 8 | 16 |
| Zinc oxide *3 | 23 | 18 | 28 | 24 | 28 | 28 | 25 |
| Dicumyl peroxide *4 | 1 | 1 | 1 | 1 | 1 | 1 | 1 |
| (Outer layer core composition) | | | | | | | |
| Polybutadiene *1 | 100 | 100 | 100 | 100 | 100 | 100 | 100 |
| Zinc acrylate *2 | 22 | 22 | 10 | 22 | 22 | 10 | 22 |
| Zinc oxide *3 | 23 | 23 | 27 | 23 | 23 | 27 | 23 |
| Dicumyl peroxide *4 | 1 | 1 | 1 | 1 | 1 | 1 | 1 |

*1: Polybutadiene (trade name "BR-01") available from JSR Co., Ltd. (Content of 1,4-cis-polybutadiene: 97.1%)
*2: Zinc acrylate from Asada Chemical Co., Ltd.
*3: Zinc oxide available from Toho Aen Co. 1 Ltd.
*4: Dicumyl peroxide (trade name "Percumyl D") available from Nippon Yushi Co., Ltd. (Half-life period at 175° C.: 1 minute)

(vi) Preparation of Cover Compositions

The formulation materials shown in Table 5 were mixed using a kneading type twin-screw extruder to obtain pelletized cover compositions. The extrusion condition was, a screw diameter of 45 mm, a screw speed of 200 rpm, and a screw L/D of 35.

The formulation materials were heated at 200 to 260° C. at the die position of the extruder.

TABLE 5

| Cover composition | Amount (parts by weight) |
|---|---|
| Hi-milan 1605 *5 | 50 |
| Hi-milan 1706 *6 | 50 |
| Titanium dioxide *7 | 2 |

*5 Hi-milan 1605 (trade name), ethylene-methacrylic acid copolymer ionomer resin obtained by neutralizing with sodium ion, manufactured by Mitsui Du Pont Polychemical Co., Ltd.
*6 Hi-milan 1706 (trade name), ethylene-methacrylic acid copolymer ionomer resin obtained by neutralizing with zinc ion, manufactured by Mitsui Du Pont Polychemical Co., Ltd.
*7 A 100 (trade name), available from Ishihara Sangyo Co., Ltd.

Examples 1 to 18 and Comparative Examples 1 to 7

The cover composition was covered on the resulting core 4 having three-layered or two-layered structure by injection molding to form a cover layer 3. Then, paint was applied on the surface to produce golf ball having a diameter of 42.7 mm and a weight of 45.0 to 45.4 g. After the resulting golf ball was cut into two equal parts, elastic modulus of each layer of the core (a, b and c) was measured, and diameter of the inner layer core and thickness of the intermediate layer core and outer layer core, which are used for indicating the position of the intermediate layer core, were measured. The results are shown in Tables 6 to 9. The elastic modulus difference between the lowest elastic modulus layer in the outer layer core other than the inner layer core and the inner layer core, and the position of the lowest elastic modulus layer (a distance from the center point of the core) core were calculated from the values. The results are also shown in the same Tables. With respect to the resulting golf balls, the coefficient of restitution, flight performance (flight distance, launch angle and spin amount) and shot feel were measured or evaluated. The test methods are as follows.

Test Method (1) Elastic Modulus

The complex elastic modulus (E*) was measured using a viscoelastic spectrometer DVA-200, manufactured by Shimadzu Co., at the conditions described as follows.

Sample size: 20 mm(length)×0.5 mm(thickness)×4 mm(width)

Deformation mode: simple stretching (in the direction of the length)

Distance between chucks: 10 mm

Initial strain: 1% (0.2 mm)

Vibrational amplitude: 0.25% (25 μm)

Frequency: 10 Hz

Temperature: Room temperature (2) Coefficient of Restitution

An aluminum cylinder having a weight of 200 g was struck at a speed of 45 m/sec against a golf ball, and the velocity of the cylinder and the golf ball before and after the strike were measured. The coefficient of restitution of the golf ball was calculated from the velocity and the weight of both the cylinder and the golf ball. The measurement was conducted 5 times for each golf ball, and the average is shown as the coefficient of restitution of the golf ball, which is indicated by an index when that of Comparative Example 1 is 100. The larger the index is, the more excellent the rebound characteristics are.

(3) Flight Performance

After a No.1 wood club (a driver) having a metal head was mounted to a swing robot manufactured by True Temper Co. and the golf ball was hit at a head speed of 35 m/sec, the launch angle, spin amount and flight distance were measured. The spin amount was measured by continuously taking a photograph of a mark provided on the hit golf ball using a high-speed camera. As the flight distance, total that is a distance to the stop point of the hit golf ball was measured. The measurement was conducted 5 times for each golf ball (n=5), and the average is shown as the result of the golf ball.

(4) Shot Feel

The shot feel of the golf ball is evaluated by 10 golfers according to a practical hitting test using a No. 1 wood club (W#1, a driver) having a metal head. The evaluation criteria are as follows. The results shown in the Tables below are based on the fact that the most golfers evaluated with the same criterion about shot feel.

○: The golfers felt that the golf ball has small impact force, and good shot feel.

Δ: The golfers felt that the golf ball has fairly good shot feel.

x: The golfers felt that the golf ball has large impact force, and poor shot feel.

TABLE 6

| | Example No. | | | | | |
|---|---|---|---|---|---|---|
| Test item | 1 | 2 | 3 | 4 | 5 | 6 |
| Elastic modulus of core (MPa) | | | | | | |
| Inner layer core (a) | 88 | 88 | 88 | 58 | 155 | 88 |
| Intermediate layer core (b) | 10 | 40 | 58 | 10 | 58 | 40 |
| Outer layer core (c) | 88 | 88 | 88 | 88 | 88 | 88 |
| Lowest elastic modulus layer (d) | b | b | b | b | b | b |
| Elastic modulus difference (a–d) | 78 | 48 | 30 | 48 | 97 | 48 |
| Diameter of inner layer core (mm) | 20.4 | 20.4 | 20.4 | 20.4 | 33.4 | 20.4 |
| Thickness of intermediate layer core (mm) | 2.0 | 2.0 | 2.0 | 2.0 | 2.0 | 0.3 |
| Thickness of outer layer core (min) | 7.0 | 7.0 | 7.0 | 7.0 | 0.5 | 8.7 |
| Position of (d) (distance from the center point of core) | | | | | | |
| Inner | 10.2 | 10.2 | 10.2 | 10.2 | 16.7 | 10.2 |
| Outer | 12.2 | 12.2 | 12.2 | 12.2 | 18.7 | 10.5 |
| Diameter of core (mm) | 38.4 | 38.4 | 38.4 | 38.4 | 38.4 | 38.4 |
| Thickness of cover (mm) | 2.3 | 2.3 | 2.3 | 2.3 | 2.3 | 2.3 |
| Physical properties of golf ball | | | | | | |
| Coefficient of restitution | 105 | 108 | 109 | 104 | 110 | 110 |
| Flight distance (yard) | 107 | 107 | 108 | 107 | 108 | 108 |

TABLE 6-continued

| Test item | Example No. 1 | 2 | 3 | 4 | 5 | 6 |
|---|---|---|---|---|---|---|
| Launch angle (degree) | 14.50 | 14.32 | 14.22 | 14.42 | 14.20 | 14.15 |
| Spin amount (rpm) | 2712 | 2833 | 2964 | 2781 | 2989 | 2989 |
| Shot feel | ○ | ○ | ○ | ○ | Δ | ○ |

TABLE 7

| Test item | Example No. 7 | 8 | 9 | 10 | 11 | 12 |
|---|---|---|---|---|---|---|
| Elastic modulus of core (MPa) | | | | | | |
| Inner layer core | 88 | 88 | 88 | 58 | 155 | 88 |
| Intermediate layer core (b) | 40 | 40 | 40 | 88 | 88 | 40 |
| Outer layer core (c) | 88 | 88 | 88 | 10 | 88 | 10 |
| Lowest elastic modulus layer (d) | b | b | b | c | b + c | c |
| Elastic modulus difference (a–d) | 48 | 48 | 48 | 48 | 67 | 78 |
| Diameter of inner layer core (mm) | 20.4 | 20.4 | 20.4 | 27.4 | 29.4 | 29.4 |
| Thickness of intermediate layer core (mm) | 4.5 | 2.0 | 2.0 | 2.0 | 2.0 | 2.0 |
| Thickness of outer layer core (mm) | 4.5 | 10.7 | 1.3 | 3.5 | 2.5 | 2.5 |
| Position of (d) (distance from the center point of core) | | | | | | |
| Inner | 10.2 | 10.2 | 10.2 | 15.7 | 14.7 | 16.7 |
| Outer | 14.7 | 12.2 | 12.2 | 19.2 | 19.2 | 19.2 |
| Diameter of core (mm) | 38.4 | 38.4 | 41.0 | 38.4 | 38.4 | 38.4 |
| Thickness of cover (mm) | 2.3 | 2.3 | 0.9 | 2.3 | 2.3 | 2.3 |
| Physical properties of golf ball | | | | | | |
| Coefficient of restitution | 105 | 105 | 108 | 104 | 115 | 108 |
| Flight distance (yard) | 108 | 105 | 109 | 106 | 109 | 107 |
| Launch angle (degree) | 14.81 | 14.09 | 14.91 | 14.95 | 14.79 | 14.91 |
| Spin amount (rpm) | 2658 | 3026 | 2681 | 2683 | 2805 | 2706 |
| Shot feel | ○ | ○ | ○ | ○ | Δ | ○ |

TABLE 8

| Test item | Example No. 13 | 14 | 15 | 16 | 17 | 18 |
|---|---|---|---|---|---|---|
| Elastic modulus of core (MPa) | | | | | | |
| Inner layer core (a) | 58 | 88 | 155 | 88 | 88 | 88 |
| Intermediate layer core (b) | — | — | — | — | 40 | 10 |
| Outer layer core (c) | 10 | 51 | 55 | 73 | 51 | 280 |
| Lowest elastic modulus layer (d) | c | c | c | c | b | b |
| Elastic modulus difference (a–d) | 48 | 37 | 100 | 15 | 48 | 78 |
| Diameter of inner layer core (mm) | 38.4 | 32.4 | 29.4 | 38.0 | 20.4 | 32.0 |

TABLE 8-continued

| Test item | Example No. 13 | 14 | 15 | 16 | 17 | 18 |
|---|---|---|---|---|---|---|
| Thickness of intermediate layer core (mm) | — | — | — | — | 2.0 | 2.0 |
| Thickness of outer layer core (min) | 0.3 | 3.0 | 4.5 | 0.5 | 7.0 | 1.2 |
| Position of (d) (distance from the center point of core) | | | | | | |
| Inner | 19.0 | 16.2 | 14.7 | 19.0 | 10.2 | 16.0 |
| Outer | 19.3 | 19.2 | 19.2 | 19.5 | 12.2 | 18.0 |
| Diameter of core (mm) | 38.4 | 38.4 | 38.4 | 39.0 | 38.4 | 38.4 |
| Thickness of cover (mm) | 2.2 | 2.3 | 2.3 | 1.9 | 2.3 | 2.3 |
| Physical properties of golf ball | | | | | | |
| Coefficient of restitution | 103 | 110 | 114 | 103 | 100 | 105 |
| Flight distance (yard) | 105 | 108 | 109 | 104 | 102 | 103 |
| Launch angle (degree) | 14.76 | 14.96 | 14.81 | 14.80 | 14.52 | 14.11 |
| Spin amount (rpm) | 2789 | 2710 | 2793 | 2879 | 2709 | 3030 |
| Shot feel | ○ | ○ | Δ | ○ | ○ | Δ |

TABLE 9

| Test item | Comparative Example No. 1 | 2 | 3 | 4 | 5 | 6 | 7 |
|---|---|---|---|---|---|---|---|
| Elastic modulus of core (MPa) | | | | | | | |
| Inner layer core (a) | 88 | 88 | 88 | 280 | 88 | 88 | 88 |
| Intermediate layer core (b) | 88 | 140 | 10 | 58 | 10 | 10 | 40 |
| Outer layer core (c) | 88 | 88 | 25 | 88 | 88 | 25 | 88 |
| Lowest elastic modulus layer (d) | — | — | b | b | b | b | b |
| Difference (a–d) | — | — | 78 | 222 | 78 | 78 | 48 |
| Diameter of inner layer core (mm) | 13.0 | 13.0 | 24.0 | 18.0 | 8.0 | 24.0 | 20.4 |
| Thickness of intermediate layer core (mm) | 1.5 | 4.0 | 3.0 | 4.0 | 2.0 | 3.0 | 6.0 |
| Thickness of outer layer core (mm) | 4.7 | 2.2 | 6.0 | 6.2 | 13.2 | 2.0 | 3.0 |
| Position of (d) (distance from the center point of core) | | | | | | | |
| Inner | — | — | 12.0 | 9.0 | 4.0 | 12.0 | 10.2 |
| Outer | — | — | 15.0 | 13.0 | 6.0 | 15.0 | 16.2 |
| Diameter of core (mm) | 38.4 | 38.4 | 42.0 | 38.4 | 38.4 | 34.0 | 38.4 |
| Thickness of cover (mm) | 2.3 | 2.3 | 0.4 | 2.3 | 2.3 | 4.4 | 2.3 |
| Physical properties of golf ball | | | | | | | |
| Coefficient of restitution | 103 | 103 | * | 105 | 100 | 95 | 95 |
| Flight distance (yd.) | 100 | 100 | * | 100 | 101 | 98 | 98 |
| Launch angle (degree) | 13.70 | 13.63 | * | 13.49 | 13.81 | 13.85 | 14.80 |
| Spin amount (rpm) | 3362 | 3457 | * | 3410 | 3254 | 3262 | 2652 |
| Shot feel | ○ | ○ | * | x | ○ | ○ | ○ |

*The cover is broken, and the measurement can not be conducted.

In the golf balls of the present invention of Examples 1 to 11 and 14 to 15, when compared with the golf balls of Comparative Examples, the coefficient of restitution is large, the flight distance is long, the launch angle is high, the spin amount is low, the impact force at the time of hitting is small and the shot feel is good.

In the golf balls of Examples 5 and 11, which are within the range of the present invention but the elastic modulus of the inner layer core is slightly high, the shot feel is slightly poor.

In the golf ball of Example 17, which is within the range of the present invention but the thickness of the layer having lower elastic modulus than the inner layer core (intermediate layer core+outer layer core) is large, the spin amount is low, but the technical effect that the rebound characteristics are not degraded when hitting at low head speed is not sufficiently obtained, and the rebound characteristics are slightly degraded, which slightly reduces the flight distance.

In the golf ball of Example 18, which is within the range of the present invention, the elastic modulus of the outer layer core is high, and the shot feel is slightly poor. In addition, the technical effect of reducing the spin amount accomplished by the deformation of the intermediate layer core having low elastic modulus is not sufficiently obtained, and the spin amount is slightly high.

On the other hand, in the golf ball of Comparative Example 1, since all three layers in the core have the same elastic modulus, the technical effect of the present invention of accomplishing high launch angle and low spin amount by placing a low elastic modulus layer in the intermediate layer of the golf ball is not be sufficiently obtained, and the spin amount is slightly high.

In the golf ball of Comparative Example 2, since the elastic modulus of the intermediate layer core is high and the inner layer core and the outer layer core have the same elastic modulus, the technical effect of the present invention described above is not be sufficiently obtained, and the launch angle is low and the spin amount is high, which reduces the flight distance.

In the golf ball of Comparative Example 3, the diameter of the core is too large, and the thickness is small, which reduces the strength of the cover so that the measurement or evaluation of the physical properties of the golf ball can not be conducted.

In the golf ball of Comparative Example 4, since the elastic modulus of the inner layer core is high, the impact force at the time of hitting is large and the shot feel is poor, and the spin amount is high.

In the golf ball of Comparative Example 5, since the position of the lowest elastic modulus layer is present at an inner portion, the launch angle is high and the rebound characteristics are degraded. In addition, the coefficient of restitution is very small regardless of head speed.

In the golf ball of Comparative Example 6, since the diameter of the core is small, the rebound characteristics are degraded.

In the golf ball of Comparative Example 7, since the thickness of the lowest elastic modulus layer is large, the technical effect that the rebound characteristics are not degraded when hitting at low head speed by placing a low elastic modulus layer in the intermediate layer of the golf ball is not sufficiently obtained, and the rebound characteristics are degraded.

What is claimed is:

1. A multi-piece solid golf ball comprising;

a core composed of an inner layer core and at least one layer of an outer layer core formed on the inner layer, and at least one layer of a cover formed on the core, wherein the inner layer core has an elastic modulus of 50 to 200 MPa, the outer layer core comprises at least one layer of a low elastic modulus layer having an elastic modulus lower than that of the inner layer core by 15 to 100 MPa, at least one layer of the lowest elastic modulus layer having the lowest elastic modulus in the core has a total thickness of 0.2 to 5.0 mm and is placed in a range of 6.5 to 20.5 mm away from the center point of the core, and the core has a diameter of 37 to 41 mm.

2. The multi-piece solid golf ball according to claim 1, wherein the low elastic modulus layer has a total thickness of 0.2 to 5.0 mm, and is placed in a range of 6.5 to 20.5 mm away from the center point of the core.

3. The multi-piece solid golf ball according to claim 1, wherein the outer layer core has an elastic modulus of 5 to 200 MPa.

4. The multi-piece solid golf ball according to claim 1, wherein the outer layer core is formed from a vulcanized rubber composition comprising polybutadiene, a co-crosslinking agent, an organic peroxide and a filler.

5. The multi-piece solid golf ball according to claim 1, wherein the inner core layer has an elastic modulus of 55 to 170 MPa.

6. The multi-piece solid golf ball according to claim 1, wherein the inner core layer has an elastic modulus of 58 to 155 MPa.

7. The multi-piece solid golf ball according to claim 1, wherein the inner core layer has a diameter of 18.0 to 39.0 mm.

8. The multi-piece solid golf ball according to claim 1, wherein at least one layer of the lowest elastic modulus layer having the lowest elastic modulus in the core has a total thickness of 0.3 to 4.5 mm.

9. The multi-piece solid golf ball according to claim 1, wherein at least one layer of the lowest elastic modulus layer having the lowest elastic modulus in the core has a total thickness of 0.5 to 4.5 mm.

10. The golf ball according to claim 1, wherein at least one layer in the core having a total thickness of 2.0 to 5.0 mm is placed in a range of 6.5 to 20.0 mm away from the center of the core.

11. The golf ball according to claim 10, wherein at least one layer in the core is placed in a range of 6.5 to 19.5 mm from the center point of the core.

12. A three-piece solid golf ball comprising;

a core composed of an inner layer core and an outer layer core formed on the inner layer, and a cover formed on the core, wherein the inner layer core has an elastic modulus of 50 to 200 MPa, the outer layer core has an elastic modulus lower than that of the inner layer core by 15 to 100 MPa, has a thickness of 0.2 to 5.0 mm and is placed in a range of 6.5 to 20.5 mm away from the center point of the core, and the core has a diameter of 37 to 41 mm.

13. A four-piece solid golf ball comprising;

a core composed of an inner layer core and two-layer structured outer layer core formed on the inner layer, which comprises an intermediate layer and an outer layer, and a cover formed on the core, wherein the inner layer core has an elastic modulus of 50 to 200 MPa, the intermediate layer has the lowest elastic modulus in the core, has an elastic modulus lower than that of the inner layer core by 15 to 100 MPa, has a thickness of 0.2 to 5.0 mm and is placed in a range of 6.5 to 20.5 mm away from the center point of the core, the outer layer has the same elastic modulus as the inner layer core, and the core has a diameter of 37 to 41 mm.

14. The four-piece solid golf ball according to claim 13, wherein the outer layer has an elastic modulus lower than that of the inner layer core by 15 to 100 MPa.

15. The four-piece solid golf ball according to claim 13, wherein the outer layer has an elastic modulus higher than that of the inner layer core.

16. The four-piece solid golf ball according to claim 13, wherein the outer layer has the lowest elastic modulus in the core, has an elastic modulus lower than that of the inner layer core by 15 to 100 MPa, has a thickness of 0.2 to 5.0 mm and is placed in a range of 6.5 to 20.5 mm away from the center point of the core, and the intermediate layer has an elastic modulus higher than that of the inner layer core.

17. The four-piece solid golf ball according to claim 13, wherein the intermediate layer has an elastic modulus lower than that of the inner layer core by 15 to 100 MPa.

18. The four-piece solid golf ball according to claim 13, wherein the intermediate layer and outer layer:

(i) have the lowest elastic modulus in the core, (ii) have an elastic modulus lower than that of the inner layer core by 15 to 100 MPa, (iii) have a total thickness of 0.2 to 5.0 mm and are placed in a range of 6.5 to 20.5 mm away from the center point of the core.

* * * * *